United States Patent [19]

Thompson et al.

[11] Patent Number: 4,530,727

[45] Date of Patent: Jul. 23, 1985

[54] METHOD FOR FABRICATING WROUGHT COMPONENTS FOR HIGH-TEMPERATURE GAS-COOLED REACTORS AND PRODUCT

[75] Inventors: Larry D. Thompson; William R. Johnson, Jr., both of San Diego, Calif.

[73] Assignee: The United States of America as represented by the Department of Energy, Washington, D.C.

[21] Appl. No.: 351,876

[22] Filed: Feb. 24, 1982

[51] Int. Cl.[3] ..... C22F 1/02

[52] U.S. Cl. ..... 148/2; 148/6.3; 148/11.5 N; 148/20.3; 148/31.5; 376/463; 376/900

[58] Field of Search ..... 420/448, 449, 460; 148/31.5, 6.3, 2, 20.3, 11.5 N; 376/463, 900

[56] References Cited

U.S. PATENT DOCUMENTS

| | | | |
|---|---|---|---|
| Re. 28,681 | 1/1976 | Baldwin | 75/134 F |
| 2,912,323 | 11/1959 | Bieber | 75/171 |
| 2,920,956 | 1/1960 | Nisbet et al. | 75/171 |
| 2,971,838 | 2/1961 | Freche | 75/171 |
| 2,975,051 | 3/1961 | Wilson et al. | 75/171 |
| 2,977,222 | 3/1961 | Bieber | 420/449 |
| 3,093,476 | 6/1963 | Gittus | 75/171 |
| 3,094,414 | 6/1963 | Franklin et al. | 75/171 |
| 3,166,412 | 1/1965 | Bieber | 75/171 |
| 3,228,095 | 1/1966 | Bird et al. | 29/156.8 |
| 3,293,030 | 12/1966 | Child et al. | 75/171 |
| 3,322,534 | 5/1967 | Ker Shaw et al. | 75/171 |
| 3,376,132 | 4/1968 | Ker Shaw et al. | 75/171 |
| 3,390,023 | 6/1968 | Shira | 148/127 |
| 3,479,157 | 11/1969 | Richards et al. | 29/194 |
| 3,524,744 | 8/1970 | Parikh | 75/171 |
| 3,565,611 | 2/1971 | Economy | 75/171 |
| 3,576,681 | 4/1971 | Barker et al. | 148/32 |
| 3,615,376 | 10/1971 | Ross | 75/171 |
| 3,723,101 | 3/1973 | Hunt | 75/126 R |
| 3,726,722 | 4/1973 | Feerster et al. | 148/11.5 F |
| 3,748,192 | 7/1973 | Boesch | 148/32.5 |
| 3,850,624 | 11/1974 | Hulit et al. | 75/171 |
| 3,874,938 | 4/1975 | Benjamin et al. | 148/32 |
| 3,902,900 | 9/1975 | Restall et al. | 75/171 |
| 3,941,590 | 3/1976 | Watanabe | 75/171 |
| 3,973,952 | 8/1976 | Bieber et al. | 75/171 |
| 3,976,480 | 8/1976 | Watanabe | 75/171 |
| 4,078,951 | 3/1978 | Denzine | 148/32.5 |
| 4,126,495 | 11/1978 | Ghosh | 148/32 |
| 4,140,555 | 2/1979 | Garcia et al. | 148/32 |
| 4,152,488 | 5/1979 | Schilke et al. | 428/678 |
| 4,226,644 | 10/1980 | Cox et al. | 148/2 |
| 4,236,943 | 12/1980 | Korenko et al. | 148/32.5 |
| 4,245,698 | 1/1981 | Berkowitz | 166/244 |

OTHER PUBLICATIONS

Ennis, "Investigations of Experimental and Modified Commercial Alloys for the Project PNP-Nov. 1979 Status".

Rehrer et al., "Solution Treatment and Al+TI Effects on the Structure and Tensile Properties of Waspaloy," *Journal of Metals*, Feb. 1970.

*Primary Examiner*—R. Dean

*Attorney, Agent, or Firm*—Fitch, Even, Tabin & Flannery

[57] ABSTRACT

A method and alloys for fabricating wrought components of a high-temperature gas-cooled reactor are disclosed. These wrought, nickel-based alloys, which exhibit strength and excellent resistance to carburization at elevated temperatures, include aluminum and titanium in amounts and ratios to promote the growth of carburization resistant films while preserving the wrought character of the alloys. These alloys also include substantial amounts of molybdenum and/or tungsten as solid-solution strengtheners. Chromium may be included in concentrations less than 10% to assist in fabrication. Minor amounts of carbon and one or more carbide-forming metals also contribute to high-temperature strength.

16 Claims, No Drawings

METHOD FOR FABRICATING WROUGHT COMPONENTS FOR HIGH-TEMPERATURE GAS-COOLED REACTORS AND PRODUCT

The Government has rights in this invention pursuant to Contract No. DE-AT03-76ET35301 awarded by the U.S. Department of Energy.

BACKGROUND OF THE INVENTION

The present invention relates to alloys and more particularly to wrought nickel-based alloys which are useful for fabricating components of a high-temperature gas-cooled reactor.

The high-temperature gas-cooled reactor (HTGR) is a graphite-moderated, helium-cooled system capable of providing helium at temperatures as high as 850° C. to 1050° C. This helium can be used to heat steam to drive a turbine, as in a steam cycle plant, or to be used directly as in a gas-turbine power plant. More recently, emphasis has shifted to process heat applications, making the HTGR useful for a wide variety of needs such as steel or synthetic fuel production. It is in this latter capacity where the advantages of a high-temperature nuclear system are exploited to their full advantage.

As operating temperatures are increased to take advantage of efficiency considerations as well as to promote the utility of the systems, the materials requirements become more and more difficult to satisfy. Many of the metallic components are required to withstand temperatures in the range of 850° C. to 1050° C. for the lifetime of a reactor. Process heat applications, such as coal gasification, accentuate the need for higher temperatures and stringent materials capabilities. These capabilities include strength and corrosion resistance at temperatures where ordinary alloys are limited. For applications in which materials may be subjected to irradiation in a thermal neutron field, e.g. within the HTGR core containment cavity, additional capabilities may be required to limit production of transmutation species which can affect the mechanical integrity of the materials or operating efficiency of the system.

Corrosion may occur in nuclear reactors as a result of oxidation and carburization, among other processes, depending upon the alloy chemistry, the coolant composition and the internal reactor temperature. Carburization has been identified as the key concern for metallic structural materials in a HTGR. Attendant with the increase in carbon concentration in a carburized alloy is an increase in carbide precipitation particularly along planar defects, such as grain and twin boundaries. The primary effect of this additional carbide precipitation has been found to be a decrease, sometimes substantial, in tensile and creep ductilities. In some cases, a decrease in creep rupture lifetimes has been observed.

Carburization, as well as other corrosion processes, occur in a HTGR partly due to the practically inevitable impurities in the helium coolant. The impurities usually include hydrogen, methane and carbon monoxide under partial pressures as high as $5\times10^{-4}$ atm. Water is sometimes present, but in much lower concentrations. These impurities infuse into and interact with metallic components contributing to their deterioration.

Candidate materials for HTGRs have been evaluated using simulated reactor helium environments, e.g. 0.9995 atm. of helium, $5\times10^{-4}$ atm. of hydrogen, $5\times10^{-5}$ atm. of methane, $5\times10^{-5}$ atm. of carbon monoxide and trace amounts of water at temperatures ranging from 800° C. to 1000° C. A number of alloys have been tested for high-temperature strength and resistance to carburization. By way of example, IN100 (nominal composition: 50% Ni, 15% Co, 10% Cr, 5.5% Al, 4.7% Ti, 3.0% Mo, 0.18% C, 0.014% B, 0.06% Zr, and 1.0% V) and IN713LC (nominal composition: 75% Ni, 12% Cr, 4.5% Mo, 2.0% Nb, 0.05% C, 5.9% Al, 0.6% Ti, 0.10% B and 0.10% Zr) have proved to exhibit excellent high-temperature strength, with the former also having excellent resistance to carburization. (All concentrations are by weight, unless otherwise indicated.) An experimental alloy (nominal composition: 10.6% W, 6.06% Cr, 4.76% Al, 3.25% Ti, 2.05% Mo, 1.43% Nb, 0.11% Zr, 0.108% C, 0.028% B, less than 0.05% Si, less than 0.05% Mn, and the balance Ni) formed by adding 3.25% titanium to alloy M21 was found to exhibit excellent carburization resistance at high temperatures. (Ennis, P. J. "Investigations of Experimental and Modified Commerical Alloys for the Project PNP, KFA-IRW-TN-132/78", November 1978.) These alloys may be cast to shape and thus are suitable for HTGR components which can be cast to shape, such as turbine blades and vanes, and thermal barrier covers. However, none of these metals are known to be workable, e.g. cold workable or hot workable. Thus, HTGR components which require fabrication must be formed from other alloys.

No commercially available wrought alloy is known to be suitable for fabricating components for HTGR environments. Hastalloy X (nominal composition: 22% Cr, 9% Mo, 1.5% Co, 0.5% W, 18.5% Fe, and the balance Ni) and Inconel 617 (nominal composition: 22% Cr, 9% Mo, 12.5% Co, 1% Al, and the balance Ni) are workable, but exhibit unsatisfactory resistance to carburization. Additionally, a material is needed which is adapted for use in a region of high thermal neutron flux.

SUMMARY OF THE INVENTION

The present invention is directed to high-temperature, high-strength, carburization resistant, wrought alloys suitable for fabricating components in HTGRs. The alloys are nickel-based and include substantial amounts of tungsten and/or molybdenum, aluminum and titanium. The ratio of aluminum to titanium is within a preselected range. Also included are minor amounts of carbon and at least one carbide-forming metal, such as zirconium. Chromium may optionally be included in concentrations no greater than about 10% for purposes of fabrication. Boron and cobalt concentrations may be limited for applications involving high neutron flux.

DESCRIPTION OF THE PREFERRED EMBODIMENTS

The nickel-based alloys include from about 6% to about 20% by weight of molybdenum and/or tungsten. These alloys include aluminum and titanium totaling between about 1.0% to about 5.0%; the ratio of aluminum to titanium is between about 0.5 and about 2.0. Carbon is present in amounts ranging between about 0.02% to about 0.1%. Also present is at least one of the following carbide-forming alloying agents: zirconium, niobium, tantalum, vanadium and hafnium. The total concentration of these carbide-forming alloying agents is between about 0.02% and about 0.2%. Chromium may or may not be present, but, in any event, no more than 10% chromium is appropriate. Where the alloy is to be used within a reactor containment cavity or other region of high thermal neutron flux, the concentrations of cobalt and boron may be advantageously limited. Except for impurities, the balance of the alloy is nickel. The use of the expression "balance" or "balance essentially" in reference to the nickel content of the alloys, as will be understood by those skilled in the art, does not exclude the presence of other elements commonly present as incidental constituents, e.g. deoxidizing and cleansing elements, and impurities normally associated therewith in small amounts which do not adversely affect the high-temperature, high-strength, carburization resistant and wrought character of the alloys.

Solid-solution strengthened nickel-based alloys have generally proved very effective at maintaining strength at elevated temperatures. Two of the most effective solid-solution strengthening alloying agents are molybdenum and tungsten. The substantial atomic size misfit between nickel and molybdenum or tungsten creates a substantial strain in the nickel lattice which strengthens the lattice by inhibiting dislocation motion. Molybdenum and tungsten in nickel also are most effective in reducing stacking fault energy and diffusivity. Lowering the stacking fault energy, making cross slip and grain-to-grain slip transferral more difficult, and decreasing matrix solution atom diffusion rates which hinder recovery can strengthen the matrix, thus increasing creep strength. In addition, these elements can form carbides which will tend to pin grain boundaries, thus limiting grain boundary sliding, an important creep mechanism at low stresses and high temperatures. For these reasons, additions of molybdenum, and/or tungsten are included to provide the high-temperature solid-solution strengthening effect. Alloys in accordance with the present invention incorporate tungsten and molybdenum at a combined level of between about 6% and about 20%.

Aluminum and titanium are included in the alloys of the present invention to promote the growth of aluminum oxide surface scales which inhibit carburization. Aluminum oxide scales form without the presence of titanium, but these do not substantially limit carburization. Concentrations of titanium of at least one half that of the aluminum concentration appear to promote carburization resistant surface scales. Where the concentration of titanium is less than one half that of aluminum, the scales that form are only semiprotective.

By way of explanation, and not by way of limitation on the scope of the present invention, various models for the role of titanium in the formation of protective aluminum oxide scales are suggested. It may be that titanium, being a very mobile solute atom, rapidly forms a precursor oxide, $TiO_2$, on which the more stable alumina scales nucleate and grow. Titanium may also affect the defect structure of the alumina scale making carbon diffusion more difficult. Still another possibility may be that titanium acts as a carbon getter, forming titanium carbide and binding carbon until the protective alumina scale is fully developed.

To optimize the development of the protective scales, the ratio of aluminum to titanium should be close to unity, and the two elements taken together should amount to at least about 1%. Alternate embodiments incorporate Al/Ti ratios between about 0.5 to about 2.

Aluminum and titanium are required ingredients in the alloys of the present invention. Aluminum and titanium have been incorporated to strengthen nickel-based superalloys as early as 1941. $Ni_3(Al, Ti)$ preciptates form a mismatch with the primary nickel lattice. Since the intermetallic compound $Ni_3(Al, Ti)$ shows long range order, both superlattice and antiphase boundary faults occur as the result of shear; thus, strengthening occurs by dislocation interaction. Since the degree of order in $Ni_3(Al, Ti)$ increases with temperature, nickel-based alloys including aluminum and titanium show an increase in strength up to about 800° C. Increased concentrations of Al and Ti, and thus of the $Ni_3(Al, Ti)$ precipitates, result in a decrease in ductility. In order to obtain a wrought alloy, the concentration of Al and Ti should not exceed about 5% by weight, and preferably should not exceed 4% by weight.

Most high-temperature wrought alloys have been developed for applications in environments with high oxidation potential, e.g. air. Consequently, most such alloys include chromium which forms a stable and adherent chromium oxide ($Cr_2O_3$) scale which provides protection from further air oxidation. However, the oxidation potential in advanced HTGR environments is much lower (about $10^{-21}$ to $10^{-23}$ atm.) and the formation of $Cr_2O_3$ is only marginally favored at the higher operating temperatures proposed.

The chromium oxide scales do not provide protection against carburization comparable to that provided by the aluminum oxide scales. Furthermore, when the concentration of chromium is high, the formation of chromium scales competes with and inhibits the formation of the protective aluminum oxide scales. Thus, where most commercial wrought nickel alloys for high temperatures include 10% to 25% chromium, in the practice of the present invention, 9% or 10% may be considered an upper limit for chromium concentration. It is within the scope of the present invention to exclude chromium entirely from the alloy. On the other hand, rapid oxidation during fabrication may place a lower limit on the chromium concentrations, at least under some circumstances. Therefore, chromium is present in some preferred embodiments of the present invention.

A small amount of carbide-forming alloying agent is added to increase the strength levels for temperatures above 850° C. At these elevated temperatures, carbide precipitates form on dislocations, inhibiting matrix flow. A small amount of carbon, although a strengthener in its own right, is added primarily to form the carbides needed for high-temperature strength. The presence of carbon in the alloy also inhibits carbon infusion from an adjacent gas while the protective scale is being formed. Carbon is included in concentrations ranging between about 0.02% to about 0.1%. The carbide-forming alloying agent may be zirconium, niobium, vanadium, tantalum, or hafnium or mixtures thereof. The total concentration of these carbide-forming alloying agents is in the range of about 0.02% to about 0.2%. Greater quantities of carbide-forming alloying agents adversely affect the wrought character of the incorporating alloy.

For applications in which materials may be subjected to exposure to thermal neutrons the concentrations of boron and cobalt may be limited. The boron concentration of the alloy is restricted to limit embrittlement due to the generation of internal helium bubbles formed by the transmutation of boron. Preferably, the boron concentration is between 0 and about 2 ppm.

The cobalt concentration may be limited to restrict the production of the long-lived radioactive species resulting from the neutron bombardment of stable cobalt. Radioactive cobalt may be incorporated into surface corrosion products which may spall off and significantly increase the circulating activity of the reactor. Furthermore, the radioactive cobalt can render metallic components biologically hazardous and extremely difficult to remove or replace. Preferably, the concentration of cobalt in alloys adapted for high neutron flux applications is between 0 and about 0.01% by weight.

Samples of ten alloys in accordance with the present invention were tested and compared with commercially available materials. The compositions of these alloys are indicated in Table I. Alloy ingots were homogenized, forged, and rolled into plates with a thicknesses of 0.5".

TABLE I

| Alloy Designation | Chemical Composition (percent by weight) | | | | | | | |
|---|---|---|---|---|---|---|---|---|
| | Ni | Mo | W | Al | Ti | Zr | Cr | C |
| GASM901 | bal. | 10 | — | 1 | 1 | 0.03 | 8 | 0.04 |
| GASM902 | bal. | 10 | — | 1 | 2 | 0.03 | 8 | 0.04 |
| GASM903 | bal. | 10 | — | 2 | 1 | 0.03 | 8 | 0.04 |
| GASM904 | bal. | 10 | — | 2 | 2 | 0.03 | 8 | 0.04 |
| GASM905 | bal. | — | 10 | 1 | 1 | 0.03 | 8 | 0.04 |
| GASM906 | bal. | — | 10 | 1 | 2 | 0.03 | 8 | 0.04 |
| GASM907 | bal. | — | 10 | 2 | 1 | 0.03 | 8 | 0.04 |
| GASM908 | bal. | — | 10 | 2 | 2 | 0.03 | 8 | 0.04 |
| GASM909 | bal. | 4 | 8 | 2 | 2 | 0.03 | 4 | 0.04 |
| GASM910 | bal. | 4 | 8 | 2 | 2 | 0.03 | — | 0.04 |

The alloys were solution-annealed at 1175° C. for 45 minutes. Microstructural analysis of solution-annealed specimens evidenced uniformity in grain growth in longitudinal and transverse sections; this would suggest the alloys exhibit isotropic mechanical behavior. Also noted was the presence of twins and the presence of what appeared to be primary carbides, which should contribute to the enhancement of creep strength. Specimens of each alloy were tested for high-temperature stength and resistance to carburization. The specimens for the carburization test were formed into 1" by 0.25" cylinders with a hole drilled near one end for fitting into the specimen holder in the corrosion testing facility. The rolling of the samples into plates and the forming of the cylinders confirms that the alloys are indeed workable.

The strengths of the ten alloys as tested, along with those of four commercial alloys, at room temperature and at 900° C. are presented in Table II. The values for the commercial alloys are linear interpolations based on values obtained at 871° C. (1600° F.) and 982° C. (1800° F.).

As can be seen from Table II, the ten alloys vary considerably in yield and ultimate strength. As a group, they manifest comparable or superior high-temperature strengths to those of the two commercial wrought alloys, Hastelloy X and Inconel 617. Thus, the present invention provides workable alloys which exhibit high-temperature strength characteristics suitable for HTGR applications.

The ten alloy embodiments and the four commercial embodiments were tested for carburization resistance at elevated temperatures by exposure to a simulated reactor environment ($5\times10^{-4}$ atm. $H_2$, $5\times10^{-5}$ atm. CO, $5\times10^{-5}$ atm. $CH_4$, less than $5\times10^{-7}$ atm. $H_2O$ and the balance He).

TABLE II

| ALLOY | SUMMARY OF TENSILE PROPERTIES | | | | | |
|---|---|---|---|---|---|---|
| | 0.2% Yield Strength KPSI | Ultimate Strength KPSI | Percent Elongation [1 in. gauge length] | 0.2% Yield Strength KPSI | Ultimate Strength KPSI | Percent Elongation [1 in. gauge length] |
| | ROOM TEMPERATURE | | | 900° C. | | |
| 901 | 47.4 | 101.0 | 67.0 | 22.6 | 27.4 | 77 |
| 902 | 42.4 | 111.1 | 70.0 | 28.7 | 29.2 | 84 |
| 903 | 45.4 | 104.4 | 75.0 | 29.2 | 31.0 | 74 |
| 904 | 77.1 | 140.8 | 52.0 | 57.5 | 58.2 | 17 |
| 905 | 37.8 | 99.8 | 69.0 | 23.5 | 23.9 | 124 |
| 906 | 38.1 | 104.9 | 73.0 | 26.5 | 26.6 | 132 |
| 907 | 43.0 | 108.6 | 70.0 | 24.5 | 24.9 | 132 |
| 908 | 93.3 | 154.2 | 43.0 | 61.8 | 62.0 | 23 |
| 909 | 41.0 | 104.5 | 67.0 | 25.8 | 26.0 | 90 |
| 910 | 66.6 | 129.1 | 63.0 | 41.5 | 41.5 | 38 |
| IN100 | 123 | 147 | 9 | 89 | 116 | 6 |
| IN713LC | 109 | 130 | 15 | 73 | 98 | 15 |
| HASTELLOY X | 52 | 114 | 43 | 23 | 33 | 49 |
| INCONEL 617 | 43 | 107 | 70 | 26 | 35 | 19 |

TABLE III

INCREASE IN BULK CARBON CONCENTRATION AFTER 1000H EXPOSURE TO SIMULATED ADVANCED REACTOR HELIUM ENVIRONMENT

| Alloy | $C_c$ (wt %) | | |
|---|---|---|---|
| | 800° C. | 900° C. | 1000° C. |
| 901 | +0.005 | −0.001 | +0.011 |
| 902 | −0.001 | +0.003 | −0.003 |
| 903 | +0.007 | +0.002 | −0.015 |
| 904 | −0.002 | −0.002 | +0.009 |
| 905 | +0.004 | +0.004 | +0.024 |
| 906 | +0.003 | +0.005 | +0.035 |
| 907 | +0.003 | +0.002 | +0.024 |
| 908 | +0.002 | +0.001 | +0.014 |
| 909 | +0.005 | +0.002 | +0.038 |
| 910 | +0.003 | +0.002 | +0.015 |
| IN100 | 0.002 | 0.007 | 0.016 |
| IN713LC | −0.001 | 0.030 | 0.041 |
| HASTELLOY X | 0.039 | 0.050 | 0.050 |
| INCONEL 617 | 0.043 | 0.018 | 0.051 |

The results of the carburization tests on the alloys, conducted for 1000 hours at 800° C., 900° and 1000° C., are presented in Table III. For purposes of comparison, Table III also includes carburization data on four commercial alloys.

As Table III indicates, the ten samples in accordance with the present invention manifest excellent resistance to carburization at elevated temperatures. At 900° C. and 1000° hours, all of the ten alloys in accordance with the present invention show carburization resistance superior to those of the four commercial alloys. The comparisons are paralleled at 1000° C. with the exception that IN100 shows carburization resistance superior to four of the ten alloys.

Metallographic analysis reveals thin, continuous, adherent aluminum oxide surface scales on all ten specimens of the present invention exposed to the simulated environment. This analysis supports the assertion that the formation of aluminum oxide surface scales inhibits carburization.

Most important is the comparison of the ten samples with the two commercial wrought alloys, Hastelloy X and Inconel 617. The inventive alloys are uniformly superior at 800° C., 900° C. and 1000° C. Thus, the alloys in accordance with the present invention have a resistance to carburization at elevated temperatures superior to available commercial wrought materials and comparable or superior to the most resistant of cast commercial alloys.

In summary, the present invention provides a range of wrought alloys which are characterized by high strength and excellent resistance to carburization at elevated temperatures. Nuclear reactor components may be fabricated by working alloys in the disclosed range into the desired shape. Accordingly, the present invention provides a method and alloys well suited for the fabrication of wrought components exposed to HTGR environments with impure helium.

What is claimed is:

1. A method of fabricating a high-temperature high-strength, carburization-resistant structural component of a high-temperature gas-cooled reactor, said component having a predetermined shape, comprising:

forming an alloy consisting essentially of between 0 and about 10 percent by weight chromium, between about 0.02 and about 0.1 percent by weight carbon; between about 0 and 0.2 percent by weight zirconium; between 0 and about 0.2 percent by weight niobium; between 0 and about 0.2 percent by weight vanadium; between 0 and about 0.2 percent by weight tantalum; between 0 and about 0.2 percent by weight of hafnium, at least one of zirconium, niobium, vanadium, tantalum and hafnium being present for forming carbides, the sum of the contents of zirconium, niobium, vanadium, tantalum and hafnium totaling between about 0.02 and about 0.2 weight percent; between 0 and about 20 percent by weight of tungsten; between 0 and about 20 percent by weight of molybdenum, the sum of the tungsten and molybdenum contents totaling between about 6 and about 20 percent by weight; aluminum and titanium, the sum of the aluminum and titanium contents totaling between about 1 and about 5 percent by weight, the ratio of the percentage by weight of aluminum to the percentage by weight of titanium being between about 0.5 and about 2, balance nickel and incidental impurities not detrimental to malleability, strength and carburization resistance at temperatures up to 1050° C.;

working the alloy into the predetermined shape; and exposing said worked alloy to an atmosphere having an oxidation potential of between about $10^{-21}$ and about $10^{-23}$ atmospheres at a temperature of between about 850° C. and about 1050° C., whereupon a titanium-stabilized aluminum oxide coating is formed on the surface of said worked alloy that protects said alloy from subsequent carburization.

2. A structural component for use in contact with the coolant gas environment of a nuclear reactor, said component being formed of a nickel-based wrought alloy consisting essentially of between 0 and about 10 percent by weight chromium;

between about 0.02 and about 0.1 percent by weight carbon;

between 0 and about 0.2 percent by weight zirconium;

between 0 and about 0.2 percent by weight niobium;

between 0 and about 0.2 percent by weight vanadium;

between 0 and about 0.2 percent by weight tantalum;

between 0 and about 0.2 percent by weight of hafnium;

at least one of zirconium, niobium, vanadium, tantalum and hafnium being present for forming carbides, the sum of the zirconium, niobium, vanadium, tantalum and hafnium contents totaling between about 0.02 and about 0.2 percent by weight;

between 0 and about 20 percent by weight of tungsten;

between 0 and about 20 percent by weight of molybdenum, the sum of the tungsten and molybdenum contents totaling between about 6 and about 20 percent by weight;

aluminum and titanium, the sum of the aluminum and titanium contents totaling between about 1 and about 5 percent by weight and the ratio of the percentage by weight of aluminum to the percentage by weight of titanium being between about 0.5 and about 2;

balance nickel and incidental impurities;

said component having a titanium-stabilized aluminum oxide coating formed by exposure of said alloy component to an atmosphere having an oxidation potential of between about $10^{-21}$ and about $10^{-23}$ atmospheres at a temperature of between about 850° C. and about 1050° C.

3. The component of claim 2 wherein said tungsten and molybdenum total between about 10 and about 12 percent by weight.

4. The component of claim 2 wherein said alloy contains between 0 and about 8 percent by weight of chromium.

5. The component of claim 2 wherein said alloy contains about 0.04 weight percent carbon.

6. A method according to claim 1 wherein said alloy is formed with a weight percent of aluminum about equal to the weight percent of titanium.

7. The method according to claim 1 wherein the carbide-forming element is zirconium.

8. A method according to claim 7 wherein said alloy is formed having about 0.02 percent by weight zirconium.

9. A method according to claim 1 wherein said alloy is formed with tungsten and molybdenum totalling between about 10 and about 12 percent by weight.

10. A method according to claim 1 wherein said alloy is formed having about 0.04% by weight carbon.

11. A method according to claim 1, forming said alloy with a controlled amount of boron so that boron comprises between about 0 and about 2 parts per million.

12. The method according to claim 1, forming said alloy with a controlled amount of cobalt is so that cobalt comprises between about 0 and about 0.01 percent by weight.

13. The component of claim 2 further characterized in that the ratio of the percentage by weight of aluminum to the percentage by weight of titanium is about 1.

14. The component of claim 2 further characterized in that zirconium is the element selected from the carbide-forming group.

15. The component of claim 2 further characterized in that the concentration of boron is between 0 and 2 parts per million.

16. The component of claim 2 further characterized in that the concentration of cobalt is between 0 and about 0.01 percent by weight.

* * * * *